US006604770B1

(12) United States Patent
Van Geijlswijk

(10) Patent No.: US 6,604,770 B1
(45) Date of Patent: Aug. 12, 2003

(54) DEVICE FOR CLAMPING A CRATE

(75) Inventor: Petrus Johannus Van Geijlswijk, Voorschoten (NL)

(73) Assignee: Heineken Technical Services B.V., Zoeterwoude (NL)

( * ) Notice: Subject to any disclaimer, the term of this patent is extended or adjusted under 35 U.S.C. 154(b) by 0 days.

(21) Appl. No.: 09/937,133

(22) PCT Filed: Mar. 20, 2000

(86) PCT No.: PCT/NL00/00182

§ 371 (c)(1),
(2), (4) Date: Sep. 21, 2001

(87) PCT Pub. No.: WO00/56607

PCT Pub. Date: Sep. 28, 2000

(30) Foreign Application Priority Data

Mar. 23, 1999 (NL) ..... 1011645

(51) Int. Cl.[7] ..... B66C 1/28
(52) U.S. Cl. ..... 294/97; 294/81.51
(58) Field of Search ..... 294/62, 67.3, 67.31, 294/68.3, 90, 93–95, 97, 81.5, 81.51, 81.56, 81.61, 82.31, 106, 110.1, 113, 114, 902

(56) References Cited

U.S. PATENT DOCUMENTS

| | | | | | |
|---|---|---|---|---|---|
| 1,035,728 | A | * | 8/1912 | Peck | 294/97 |
| 1,500,904 | A | * | 7/1924 | Shipley | 294/97 X |
| 3,257,142 | A | * | 6/1966 | Barry | 294/81.51 X |
| 3,549,126 | A | * | 12/1970 | De Vries | 294/113 X |
| 5,263,813 | A | * | 11/1993 | Kiederle et al. | 294/67.31 X |
| 6,062,620 | A | * | 5/2000 | Walker et al. | 294/67.31 |

FOREIGN PATENT DOCUMENTS

| | | | | |
|---|---|---|---|---|
| FR | 1518894 | * | 3/1968 | |
| SU | 1133218 | * | 1/1985 | 294/81.51 |
| SU | 1618721 | * | 1/1991 | 294/67.31 |
| SU | 1677002 | * | 9/1991 | 294/67.31 |
| SU | 1766820 | * | 10/1992 | 294/81.51 |

* cited by examiner

*Primary Examiner*—Dean J. Kramer
(74) *Attorney, Agent, or Firm*—Sughrue Mion, PLLC

(57) ABSTRACT

The invention relates to a device for clamping a crate (2), comprising a frame or a plate provided with at least a first and a second clamping element (6) for engaging on an interior section of the wall of the crate, which clamping elements are mounted some distance apart, wherein at least the first clamping element is provided with a clamping projection (31) which is movable with respect to the second clamping element.

8 Claims, 2 Drawing Sheets

DEVICE FOR CLAMPING A CRATE

The present invention relates to a device for clamping a crate, comprising a frame or a plate provided with at least a first and a second clamping element for engaging on an interior section of the wall of the crate, which clamping elements are mounted some distance apart.

Such a device is known in the prior art. The device is used inter alia when applying an image to a crate. Crates, such as beer crates, are usually provided on the outside with a tradename or other advertising. In order to be able to apply these images to the crates, the crates are fed past a printing station with the aid of a conveyor belt. At the printing station an image can be pressed or transfer printed on to the wall of the crate with the aid of an applicator head.

When applying the image, a laterally directed force is exerted on the crate by the applicator head. To prevent the applicator head pushing the crate off the conveyor belt, the crate is clamped from the top with the aid of a clamping device of the type specified in the preamble.

This device is, for example, constructed as a plate, the dimensions of which are matched to the inside dimensions of the crate. The outer edges of the clamping plate are used as clamping elements, which engage on the inside walls of a crate.

Before an image is applied to the side wall of the crate by the applicator head the clamping plate is placed in the crate from the top. The presence of the clamping plate firstly prevents the crate being pushed laterally off the conveyor belt. Secondly, the clamping plate prevents the side wall of the crate, which is exposed to the lateral pressure of the applicator head, from deforming excessively. The greater the deformation of the side wall,the more difficult it becomes to apply a smooth, non-deformed image to the crate.

In order to be able to achieve a sufficiently high throughput speed at a printing station, it is not a single clamping plate that is used but several clamping plates, positioned in series, to clamp the successive crates. The clamping plates are attached to an endless conveyor device which in the vicinity of the printing station runs parallel to the conveyor belt by means of which the crates are fed to the printing station. A clamping plate is placed in the crate a certain distance before the printing station. The endless conveyor pushes the clamping plate down into a crate. After leaving the printing station, the plate is removed from the crate again by moving the clamping plate upwards, out of the crate, by means of the endless conveyor.

A known problem when clamping the crates using clamping plates according to the prior art is the relatively large variation in the dimensions of the crates. As a result of, inter alia, shrink variations which occur during the production of the crate, the interior of virtually every crate is just slightly different from that of the other crates.

For this reason there are two possibilities for use of the clamping plates according to the prior art. Firstly, the dimensions of the clamping plate can be chosen to be relatively large, so that even the crates with relatively large inside dimensions can be clamped by the plate. In this case, however, there is the risk that in the case of crates with relatively small inside dimensions the clamping plate will become so jammed in the crate that the crate no longer detaches from the clamping plate when the clamping plate is moved upwards with the aid of the endless conveyor. In this case the crate moves up together with the clamping plate after leaving the printing station. In order to be able to detach the crate from the clamping plate the production line has to be shut down, with all the associated disadvantages (such as lost time). Moreover, there is a risk that as the crate moves upwards it will damage the installation itself. Secondly, it is possible to match the external dimensions of the clamping plate to the internal dimensions of the smallest crates. The effect of this is that none of the crates remain attached to the clamping plate when this plate is moved upwards downstream of the printing station. A significant disadvantage of this measure, however, is that there is unavoidable play between the inside walls of the crates and the outer edges of the clamping plates. First of all, this play is reflected in inaccuracy in the positioning of the crate. Moreover, as a result of the play which is present, the wall of the crate is able to deform at least until the top edge of the crate comes into contact with the outer edge of the clamping plate. As has been stated above, this deformation will have an adverse effect on the image applied.

The aim of the present invention is to provide a device of the type specified in the preamble which does not have the disadvantages described above.

Said aim is achieved in the present invention in that at least the first clamping element is provided with a clamping projection which is movable with respect to the second clamping element.

By mounting at least one of the clamping elements such that it is movable, the clamping device can first of all be placed between the walls of the crate. The clamping projection can then be moved so that the clamping projection comes into engagement with an inside wall of the crate. By mounting the clamping projection such that it is movable any deviations in dimensions between the crates can thus be compensated for and every crate can be clamped without play.

A further effect of mounting the clamping projection such that it is movable is that it is possible not only to compensate for small differences in size between crates of one type but also to clamp different types of crates using one and the same clamping device. The greater the distance over which the clamping projection can be moved, the greater can be the differences between the crates which can be compensated for with the device according to the invention.

According to the invention it is possible that the first clamping element comprises a striking projection which is movable with respect to the plate or the frame, the striking projection and the clamping projection being mechanically coupled in such a way that movement of the striking projection relative to the plate or the frame gives rise to a movement of the clamping projection relative to the second clamping element.

What is achieved by means of this measure is that when the device is moved towards a crate to be clamped the striking surface can be pushed into contact with the top edge of a crate. As a result of the mechanical coupling of the striking projection and the clamping projection, the clamping projection is, as a consequence thereof, moved relative to the second clamping element. The distance between the clamping projection and the second clamping element increases, as a result of which the inside wall of the crate is clamped between, on one side, the clamping projection and, on the other side, the second clamping element.

As a result of this mechanical coupling between the striking projection and the clamping projection, the clamping device according to the invention can be of relatively simple construction. If the clamping projection were, for example, to be driven hydraulically and the clamping devices were to be attached to an endless conveyor, a large series of liquid-tight couplings would have to be made in the device. Such couplings are relatively expensive and susceptible to malfunction. As a result of the mechanical connection between the striking projection and the clamping projection according to the invention, the hydraulic lines and the associated coupling elements are superfluous.

If the device is constructed as a flat body, such as a plate, a force can be exerted on the top edge of the beer crate with the aid of the plate. The beer crate is thus pushed against a support with the aid of the plate. The pressure of the plate on the top edge of the crate in conjunction with the clamping force of the clamping projection and the clamping element ensure that the crate is firmly clamped.

According to the invention it is possible that the first clamping element is constructed as a pivoting body having a striking surface and a clamping surface, the striking surface and the clamping surface being arranged a rotational distance away from one another.

What is achieved by means of this measure is that the construction of the device is kept very simple. By exerting a force on the striking surfaces the clamping surface is moved. The striking projection and the clamping projection are thus rigidly connected to one another in a single pivoting body. The two projections are constructed as a surface portion of one and the same body.

According to the invention it is possible that the second clamping element is constructed as a pivoting body.

What is achieved by means of this measure is that on engaging on a crate, the two striking surfaces of the two pivoting bodies are moved in contact with the inside wall of the crate. In this way the clamping force is symmetrically transmitted to the crate.

According to an advantageous embodiment it is possible that the pivoting body is essentially constructed as a cylinder, the pivoting body comprising a first and a second strip which are fixed, essentially parallel, on the housing of the cylinder. With this arrangement it is possible that the first and the second pivoting body extend essentially parallel with respect to one another in the frame or the plate.

What is achieved by means of this measure is that the clamping surface and the striking surface are relatively long. This means that rotation of the pivoting body can be effected by a relatively large striking surface and that clamping of the crate can take place with a relatively large clamping surface. As a result the surface pressure itself can be kept low, whilst an adequate clamping force is nevertheless achieved.

By arranging the pivoting bodies in parallel, the clamping surfaces can engage on two side walls running parallel.

According to an advantageous embodiment provision is made for the first strip to be heavier than the second strip.

As has already been pointed out above, the device according to the invention can be used in a vertical set-up, the clamping device being placed in the crates from the top. This means that gravity can be used for bringing the pivoting bodies into the correct starting position. Since the first strip is of heavier construction than the second strip, the pivoting bodies will be forced by the weight of the relatively heavy first strips into their fixed starting position if the clamping device does not make contact with a crate to be clamped. The clamping device can be moved vertically downwards from this starting position in the direction of the crate.

According to the invention it is furthermore possible that the pivoting body or the pivoting bodies are accommodated in passages through the frame or the plate. Moreover, the frame or the plate can have a top and a bottom, the bottom facing towards a crate when the device is in use. With this arrangement it is possible for the cross-section of the passages to decrease from the bottom of the frame or the plate.

What is achieved by means of this measure is firstly that the construction of the clamping device can be kept relatively simple. Secondly, what is achieved is that the maximum pivoting angle of the pivoting body relative to the flat body is restricted.

The present invention will be further explained with reference to the appended drawings, in which.

As already stated above, the present invention is suitable, in particular, for clamping a beer crate. The description below explains the use of the clamping device for an application in which the side walls of beer crates are provided with an imprint.

Figure 1:
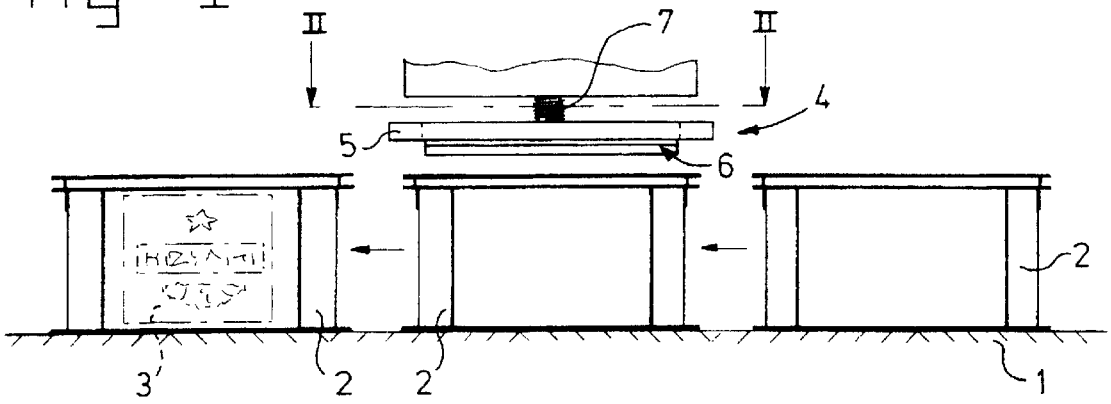
FIG. 1 shows a side view of a possible use of the clamping device according to the present invention, in which beer crates which are provided with an imprint on the outside are clamped using the clamping device.

FIG. 1 shows, diagrammatically, a conveyor belt 1 on which three successive beer crates 2 are shown. The beer crates 2 move from right to left viewed in the drawing. With the aid of the conveyor belt 1 the beer crates are fed past an applicator head (see also FIG. 2) which applies an image 3 to the side wall of the beer crate, inter alia with the aid of a laterally directed force.

To prevent the beer crate 2 falling from the conveyor belt 1 under the influence of this lateral force, the beer crate 2 is pushed from the top onto the conveyor belt 1 with the aid of the clamping device 4. This clamping device 4 comprises an essentially flat body, such as a plate 5, which is provided with two or more pivoting bodies 6 (see in particular FIGS. 2, 3 and 4). The plate 5 can be moved in the vertical direction with the aid of drive means 7. These drive means can be any suitable drive means, such as, for example, a hydraulic cylinder or a spindle.

Figure 2:
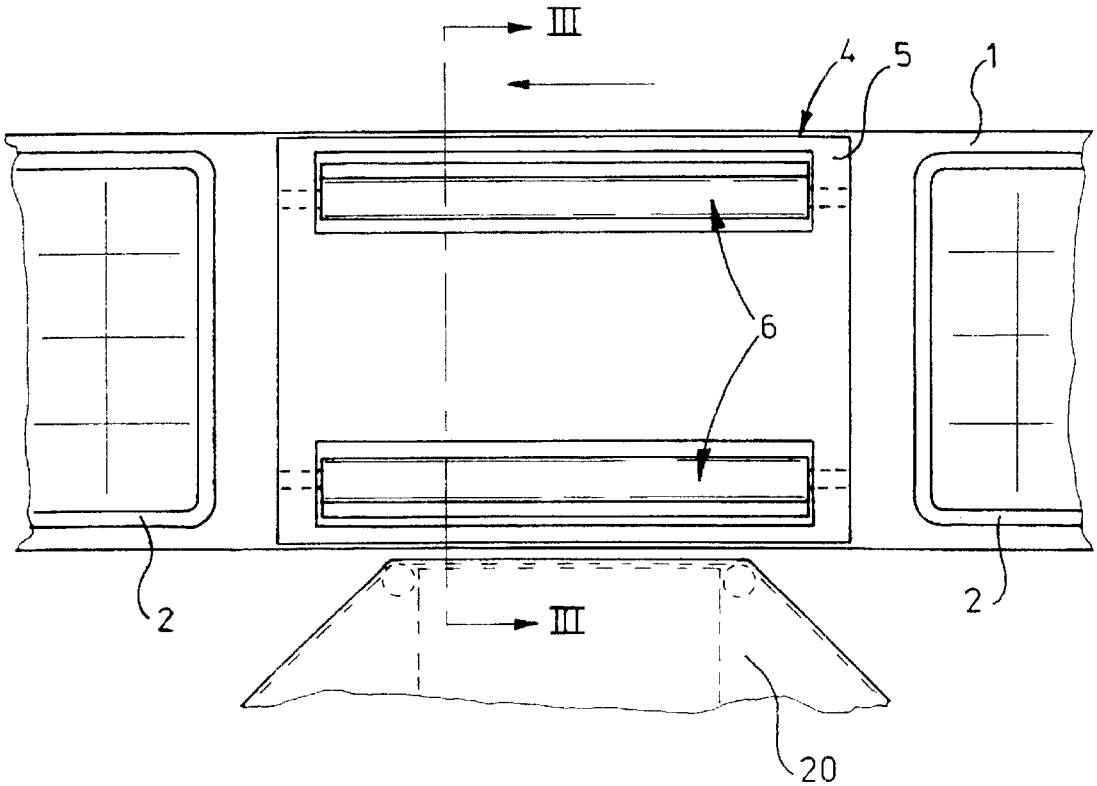
FIG. 2 is a plan view of a clamping device between section lines 11—11 of FIG. 1 according to the present invention which is used in accordance with the use in FIG. 1.

FIG. 2 shows a plan view of the clamping device 4 according to FIG. 1. The beer crates 2, on the side walls of which an image has to be applied, are again shown in FIG. 2. It can be seen from FIG. 2 that the clamping device 4 comprises a flat plate 5 in which two pivoting bodies 6 have been rotatably mounted. With the aid of the flat plate 5 vertical force can be exerted on the top edge of the crate 2. With the aid of the pivoting bodies 6 an outwardly directed clamping force can also be applied to the top edge of the sides facing towards an applicator head 20. What is achieved in this way is firstly that the crate 2 cannot be pushed laterally off an underlying conveyor belt 1. Secondly, what is achieved is that the side wall to be printed is not able to deform excessively under the influence of the pressure of the head 20. Restriction of the deformation is necessary in order to be able to apply an image 3 of the desired quality to the side wall of a crate 2.

Figure 3:
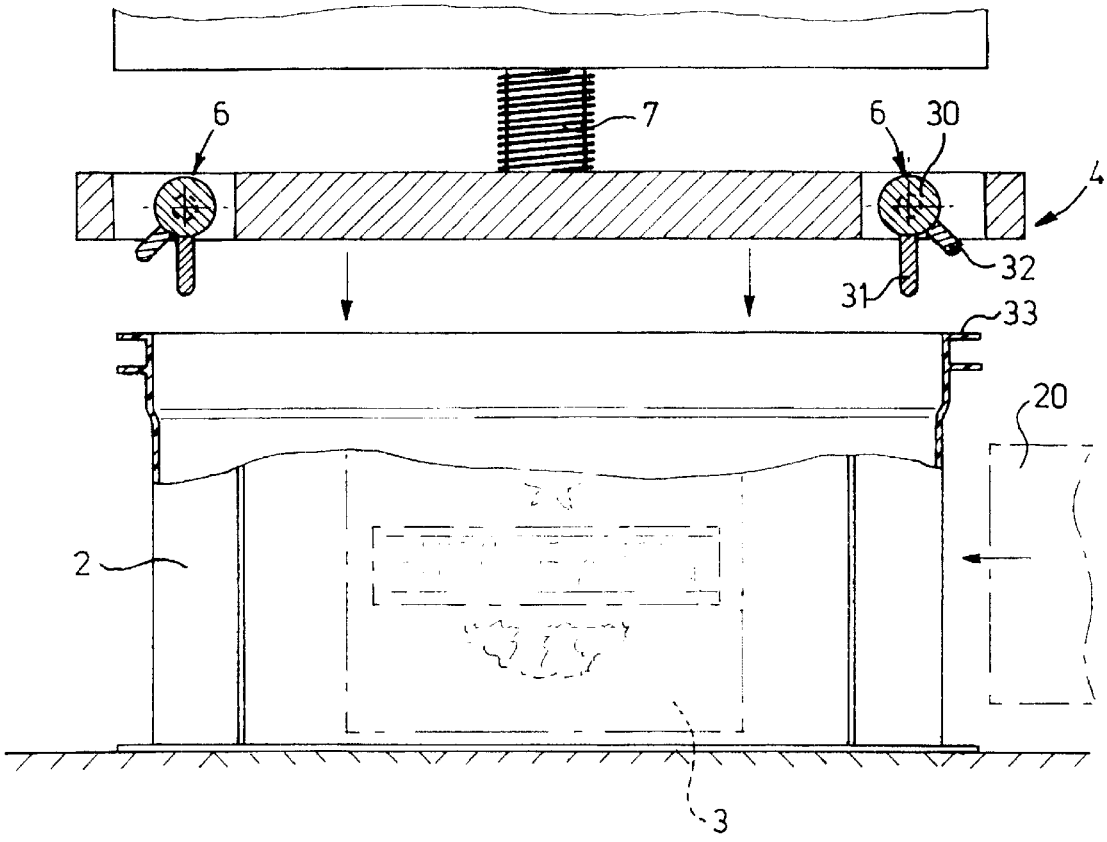
FIG. 3 shows a clamping device according to the present invention in cross-section III—III of FIG. 2 at the point in time when the clamping device is brought into engagement with a beer crate to be clamped.

FIG. 3 shows a cross-sectional side view of the clamping device 4 which is brought into engagement with the top edge of a beer crate 2. In FIG. 3 the crate 2 is shown partially in cross-section. It can be seen from FIG. 3 that the pivoting bodies 6 comprise a circular body or cylinder 30 with two strips 31, 32 arranged in the longitudinal direction thereof. The strip 31 is of heavier construction that the strip 32. This means that when the pivoting body 6 is not in engagement with an object to be clamped it will return to the starting position shown in the figure under the influence of gravity. FIG. 3 shows the case where the clamping device 4 is going to be brought into engagement with the crate 2. To this end the clamping device 4 is moved vertically downwards with the aid of the drive means 7 in the direction of the top edge of the crate 2. When bringing the pivoting bodies 6 into engagement with the top edge of the crate 2 the end of the strip 32 is guided in the direction of the top surface 33 of the crate 2. The end of the strip 32 serves as striking surface.

Figure 4:
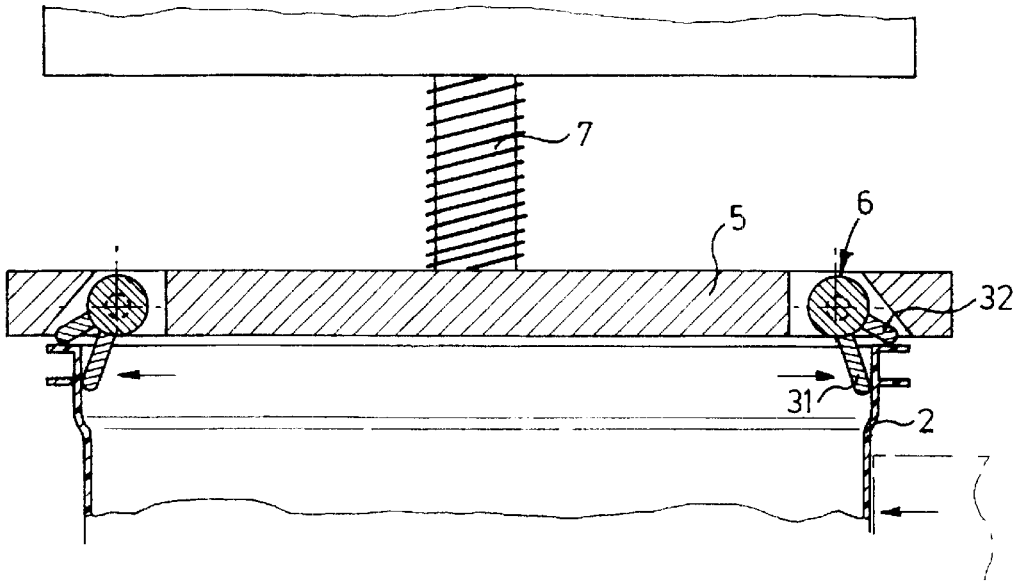
FIG. 4 shows a clamping device according to the present invention in cross-section, at the point in time when the pivoting bodies have engaged with the top edge of a beer crate.

According to FIG. 4 the ends of the strips 31, 32 have been brought into engagement with the top edge of the crate 2. It can be seen in the figures that the respective striking surfaces at the end of the two strips 32 allow the pivoting bodies 6 to rotate, in opposing directions. As a result of this pivoting movement, the ends of the strip 31, which serve as clamping surfaces, are moved apart. This means that an outwardly directly clamping force is exerted on the wall of the crate 2 by the clamping surfaces at the ends of the strips 31. This outwardly directed clamping force offers resistance to the pressure which is exerted on the side wall of the crate 2 by the applicator head 20.

It will be clear that the clamping device according to the present invention is of relatively simple design. The strips 31, which serve as clamping surfaces, do not have to be driven by external drive means. If the clamping device 4 is used in series with other clamping devices 4, complex connections from a possible external drive to the clamping devices 4 are therefore not needed. The movement of the strips 31 is a consequence of the rotation of the pivoting bodies 6, which rotation is the result of bringing the striking surfaces on the strips 32 into contact with the top edge of the crate 2. This means that as a result of a vertical movement of the plate 5 in the direction of the crate 2 not only is a vertical clamping force exerted on the crate but, as a result of the resulting pivoting movement, an outwardly directed clamping force is also exerted on the walls of the crate.

It is clear that the present invention is not restricted to the use of clamping devices for beer crates. The invention is equally suitable for use in numerous other comparable applications.

What is claimed is:

1. A device (4) for clamping a crate (2), comprising one of a frame and a plate (5) provided with at least a first clamping element (6) for engaging on a first interior section of a wall of the crate (2) and a second clamping element (6) for engaging on a second interior section of the wall of the crate (2), wherein the clamping elements (6) are mounted some distance apart, characterised in that at least the first clamping element (6) is provided with a clamping projection (31) which is movable with respect to the second clamping element (6), and a striking projection (32) which is adapted to be brought into engagement with a top edge of the crate (2) and is movable with respect to the one of the frame and the plate (5), wherein the striking projection (32) and the clamping projection (31) are mechanically coupled in that movement of the striking projection (32) relative to the one of the frame and the plate (5) due to the engagement of said striking projection (32) with the top edge of the crate (2) causes movement of the clamping projection (31) relative to the second clamping element (6).

2. The device (4) according to claim 1, characterised in that the first clamping element is constructed as a pivoting body (6), and the striking projection (32) and the clamping projection (31) are arranged a rotational distance away from one another on the pivoting body.

3. The device (4) according to claim 2, characterised in that the pivoting body (6) is a cylinder (30), and the striking projection (32) and the clamping projection (31) are fixed, parallel to one another, on a housing of the cylinder (30).

4. The device (4) according to claim 2, characterised in that the second clamping element (6) is constructed as a second pivoting body.

5. The device (4) according to claim 4, characterised in that the first pivoting body (6) and the second pivoting body (6) are accommodated in passages through the one of the frame and the plate (5).

6. The device (4) according to claim 5, wherein the one of the frame and the plate (5) has a top and a bottom and wherein the bottom faces towards the crate (2), characterised in that the cross-section of the passages decreases from the bottom of the one of the frame and the plate (5) to the top of the one of the frame and the plate (5).

7. The device (4) according to claim 4, characterised in that the first pivoting body (6) and the second pivoting body (6) extend essentially parallel with respect to one another in the one of the frame and the plate (5).

8. The device (4) according to claim 4, characterised in that the clamping is heavier than the striking projection (32).

* * * * *